US009950301B2

(12) United States Patent
Rüberg et al.

(10) Patent No.: US 9,950,301 B2
(45) Date of Patent: Apr. 24, 2018

(54) MIXING MACHINE AND ITS LINER

(71) Applicant: Dr. Herfeld GmbH & Co. KG, Neuenrade (DE)

(72) Inventors: Wolfgang Rüberg, Menden (DE); Ulrich Tölle, Detmold (DE)

(73) Assignee: DR. HERFELD GMBH & CO. KG, Neuenrade (DE)

( * ) Notice: Subject to any disclaimer, the term of this patent is extended or adjusted under 35 U.S.C. 154(b) by 64 days.

(21) Appl. No.: 15/190,426

(22) Filed: Jun. 23, 2016

(65) Prior Publication Data

US 2016/0375415 A1 Dec. 29, 2016

(30) Foreign Application Priority Data

Jun. 23, 2015 (DE) ..... 20 2015 103 284 U

(51) Int. Cl.
*B01F 13/06* (2006.01)
*B01F 15/00* (2006.01)
(Continued)

(52) U.S. Cl.
CPC .... *B01F 15/00006* (2013.01); *B01F 13/0098* (2013.01); *B01F 13/06* (2013.01);
(Continued)

(58) Field of Classification Search
USPC ..... 366/139, 184, 182.3
See application file for complete search history.

(56) References Cited

U.S. PATENT DOCUMENTS 2,398,985 A 4/1946 Welch
2,797,903 A 7/1957 Urban
(Continued)

FOREIGN PATENT DOCUMENTS

DE 202008012827 U1 11/2003
DE 202013103591 U1 8/2013
(Continued)

OTHER PUBLICATIONS

Extended European Search Report dated Nov. 25, 2016 in related European application EP16175192.0-1703.
(Continued)

*Primary Examiner* — Mark Halpern
(74) *Attorney, Agent, or Firm* — Polson Intellectual Property Law, PC; Margaret Polson

(57) ABSTRACT

A mixing machine 1 comprising a mixing head 3 having element(s) for connecting to a receptacle to form a mixing container. The mixing head 3 is pivotably supported in a frame 2 such that the mixing container can pivot for the mixing process. The mixing head 3 has at least one rotationally driven mixing tool whose drive shaft 23 extends through the wall of the mixing head 3. The mixing head 3 has a double wall with a perforated inner wall 8. The perforations form a fluid path from the chamber surrounded by the inner wall 8 to the intermediate wall chamber 10. The intermediate wall chamber 10 is connected to a pressure adjustment device for adjusting the pressure. A flexible liner 15 is arranged in the mixing head 3 on its inner surface, which liner 15 can be fixed to the inner wall 8 of the mixing head by applying a vacuum.

8 Claims, 4 Drawing Sheets

(51) Int. Cl.
*B01F 13/00* (2006.01)
*B08B 7/02* (2006.01)

(52) U.S. Cl.
CPC .. *B01F 15/00038* (2013.01); *B01F 15/00837* (2013.01); *B08B 7/02* (2013.01)

(56) References Cited

U.S. PATENT DOCUMENTS

| | | | | |
|---|---|---|---|---|
| 4,889,432 | A | 12/1989 | Patterson | |
| 4,951,843 | A | 8/1990 | Paetow | |
| 5,727,878 | A | 3/1998 | Sullivan, Jr. | |
| 6,331,070 | B1 | 12/2001 | Desai | |
| 6,505,657 | B1 | 1/2003 | Lawrence | |
| 8,678,639 | B2 | 3/2014 | Tolle et al. | |
| 8,979,354 | B2 | 3/2015 | Tolle et al. | |
| 2004/0060374 | A1 | 4/2004 | Goodin | |
| 2009/0040868 | A1 | 2/2009 | Tamminga | |
| 2010/0065149 | A1 | 3/2010 | O'Callaghan | |
| 2013/0186834 | A1* | 7/2013 | Vicalvi | G01N 30/56 210/656 |
| 2015/0078119 | A1* | 3/2015 | Ruberg | B01F 7/1605 366/182.3 |
| 2015/0290607 | A1 | 10/2015 | Tolle | |
| 2016/0375416 | A1* | 12/2016 | Ruberg | B01F 15/0278 366/184 |

FOREIGN PATENT DOCUMENTS

| | | | |
|---|---|---|---|
| EP | 0225495 | A2 | 6/1987 |
| FR | 1400858 | A | 5/1965 |

OTHER PUBLICATIONS

Pending U.S. Appl. No. 14/456,044, filed Aug. 11, 2014, inventors Ruberg et al. Copy not submitted because application is available is USPTO system.

Pending U.S. Appl. No. 15/189,275, filed Jun. 22, 2016, inventors Ruberg et al. Copy not submitted because application is available is USPTO system.

* cited by examiner

MIXING MACHINE AND ITS LINER

CROSS REFERENCE APPLICATIONS

This application is a non-provisional application claiming priority from German application no.20 2015 103 284.6 filed Jun. 23, 2015 which is hereby incorporated by reference for all purposes.

BACKGROUND

The invention relates to a mixing machine comprising a mixing head having element(s) for connecting it to a receptacle, forming a closed mixing container containing the material to be mixed. The mixing head is pivotably supported opposite a frame in such a manner that the mixing container can pivot for carrying out the mixing process, in which mixing head at least one rotationally driven mixing tool is arranged whose drive shaft extends through the wall of the mixing head. Furthermore, the invention relates to a liner, preferably for such a mixing head.

Such mixing machines concern industrial mixers which are used for mixing in particular bulk material, typically powdery bulk material, such as mixtures of plastic granulates or also in the color industry. These mixing machines comprise a mixing head pivotably supported opposite a frame. The mixing head also closes a receptacle connected to the mixing head forming this mixing container. After the receptacle has been connected to the mixing head a closed mixing container is formed. The mixing head comprises one or more connecting elements for connecting the receptacle to the mixing head, for example a circumferential flange. These mixers are also known as container mixers. The receptacle is also known as a mixing container. The mixing head itself is pivotably arranged opposite the machine frame of the mixing machine so that the mixing takes place as regards the mixing head in an upside down position in which the mixing head is at the bottom and the mixing container connected to it is at the top. In this position the bottom discharge opening of the mixing container faces upward.

This upside down position is required so that the material comes in contact with the at least one mixing tool carried by the mixing head. The rotationally driven mixing tool serves to generate a flow of material to be mixed inside the closed mixing chamber. The time of the mixing procedure determines the degree of mixing. Such an industrial mixer is known, for example, from EP 0 225 495 A2.

In such mixing machines the material is mixed in batches in the mixing receptacle formed by the mixing container and the mixing head. If the composition of the material of the material to be mixed is different between a first batch and a subsequent batch the mixing head must be cleaned. This requires a cleaning of the inner wall of the mixing head and of the mixing tool or mixing tools arranged in it. To this end to the mixing tools can be and are removed from the mixing head.

Therefore, it should be noticed in mixing machines of this type that accumulations of mixing material form in the mixing head, in particular in the area around the mixing tool or tools which accumulations can also adhere to the bottom of the mixing machine depending on the material to be mixed. These accumulations of material form already at the beginning of the mixing process with the consequence that this material is decoupled from the further mixing process. This can occur in mixing heads that have a slowly rotating first tool that typically cleans the bottom and comprise one or more rapidly rotating mixing tools such as are known, for example, from DE 20 2014 101 787 U1 or from DE 20 2009 001 937 U1. A mixing of mixing material without an appreciable charging of heat is possible with these mixing heads. Since in mixing machines with such mixing heads the mixing takes place in an upside down arrangement with mixing tools at the bottom, during the pivoting back of the mixing head into the starting position after the conclusion of the mixing procedure for decoupling the mixing container this material that was not sufficiently mixed falls onto the properly mixed mixing material located below it. Even if the amount of this falling, insufficiently mixed mixing material is in the final analysis not appreciable as regards the amount of the properly mixed mixing material, it occasionally is apparent due to its color which differs in comparison to the properly mixed mixing material. Moreover, it is undesirable if even slight amounts of mixing material are not properly mixed. In addition, it can be disadvantageous if such insufficiently mixed material adheres in the mixing head and remains in it as an unmixed or insufficiently mixed accumulation of material.

Starting from this discussed prior art, the invention therefore has the problem of further developing a mixing machine of the initially cited type so that mixing material can be properly mixed in its entirety with this machine while avoiding the previously outlined problems.

The foregoing example of the related art and limitations related therewith are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tool and methods which are meant to be exemplary and illustrative, not limiting in scope. In various embodiments, one or more of the above described problems have been reduced or eliminated, while other embodiments are directed to other improvements.

One aspect of the disclosure is an initially cited generic mixing machine in which the mixing head is constructed with a double wall. The inner wall of the double-wall construction is perforated to provide a fluid path between the chamber surrounded by the inner wall to the intermediate wall chamber provided between the inner wall and the outer wall, and the intermediate wall chamber is connected to a pressure adjustment device provided for adjusting the pressure in the intermediate wall chamber, and in which a flexible liner is arranged in the mixing head, jacketing its inner surface made available by the inner wall. The liner can be fixed to the inner wall of the mixing head by a vacuum applied in the intermediate wall chamber.

In this mixing machine the mixing head is constructed with a double wall. It is provided here that the inner wall is perforated in order to connect the inner chamber of the mixing head with a fluid path to the intermediate wall chamber located between the inner wall and the outer wall. A flexible liner is inserted into the mixing head which covers the surface of the inner wall facing in the direction of the chamber enclosed by the mixing head and as a result also closes the perforations. The intermediate wall chamber is connected to a pressure adjustment device by which the intermediate wall chamber can be loaded with pressure different from that of the ambient pressure. This allows the intermediate wall chamber to be loaded with the vacuum or with excess pressure. The pressure adjustment device therefore comprises means for making available a vacuum in the intermediate wall chamber or also an excess pressure. A vacuum pump can serve to make a vacuum available. A pressure pump serves to make an excess pressure available. Both can also be achieved by a piston-cylinder arrangement or by connecting the intermediate wall chamber to a hydraulic compensation tank.

If the liner is inserted into the mixing head, which is required for using the mixing head for mixing a material, the intermediate wall chamber is loaded with a vacuum that is, for example 0.3-0.5 bar below the ambient pressure. As a result of this measure the liner is drawn onto the inside of the inner wall and is fixed there. The mixing process is carried out with a mixing container connected to this mixing head, as is known from the prior art. In order to avoid unmixed mixing material falling onto the other, properly mixed mixing material after the conclusion of the mixing process, the mixing head with the mixing container connected to it is pivoted out of its upside down mixing position into its starting position before the conclusion of the mixing process at least once. In the starting position the mixing head is located above the mixing container. Material adhering on the liner can fall off from it during this return pivoting process and into the other mixing process. If the non-mixed or not sufficiently mixed mixing material adheres on the liner when the mixing head has been pivoted back into its starting position, the intermediate wall chamber is loaded with a certain excess pressure so that it separates from the area of the bottom of the mixing head and is deformed in this direction similar to a milling process. As a result of the deformation of the liner, the adhesive bond of particles of mixing material is loosened so that they then fall back into the mixing material located below them. After the intermediate wall chamber has been loaded again with a vacuum for a new suction of the liner, the mixing receptacle is pivoted again into the mixing position and the mixing process is continued. If during the further mixing process mixing material is again coupled out of the mixing process, this material is not non-mixed mixing material, but rather already mixed mixing material. Therefore, the mixed batch is not adversely affected when it falls back. This process can be repeated once or several times during the mixing process. For this reason, the liner is flexible.

In a preferred embodiment the liner is manufactured from an elastic polymer or of a polymer with a rubber-like elasticity wherein the inside is preferably provided with an adhesion-minimizing coating and/or is provided with such a surface structuring.

The liner has a sufficient inherent stability so that it does not collapse when an excess pressure is applied in the intermediate wall chamber but rather is merely separated from the inside of the inner wall of the mixing head. Such a pressure loading can be limited so that it acts on certain areas of the intermediate wall space and therefore on certain areas of the liner. In such a case the intermediate wall chamber is subdivided into individual segments. This inherent stability of a liner can be achieved, for example with a rubber sheet coated with PTFE which has a material thickness of 2-3 mm.

A further development provides that the liner carries a radially outward projecting, circumferential flange on its edge facing the mixing container. This flange simultaneously serves as a seal in the interface between the mixing head and a mixing container. This flange is then fixed by the counter flange of the mixing container in the cited interface, which counter flange is pressed against this flange. If the intermediate wall chamber is loaded with excess pressure in such a construction typically only the bottom will separate from the inner wall due to the inherent stability of the liner. This area is also the one in which accumulations of material are to be expected if any form.

A further development provides that a connection continuation is formed on this flange of the liner which continuation engages into a circumferential groove of an annular body closing the intermediate wall space for fixing the liner on the mixing head even without a mixing container being connected to it. The engagement of this connection continuation into the circumferential groove of the mixing head is frictional or positive.

In the first case the connection continuation engages like a lever edge into the groove. In the case of a positive connection the positive groove is designed with an undercut and the connection continuation has a thickened end section which is preferably constructed as a hollow chamber profile in order to be able to be set into the groove.

In addition to the exemplary aspects and embodiments described above, further aspects and embodiments will become apparent by reference to the accompanying drawings forming a part of this specification wherein like reference characters designate corresponding parts in the several views.

Figure 1:
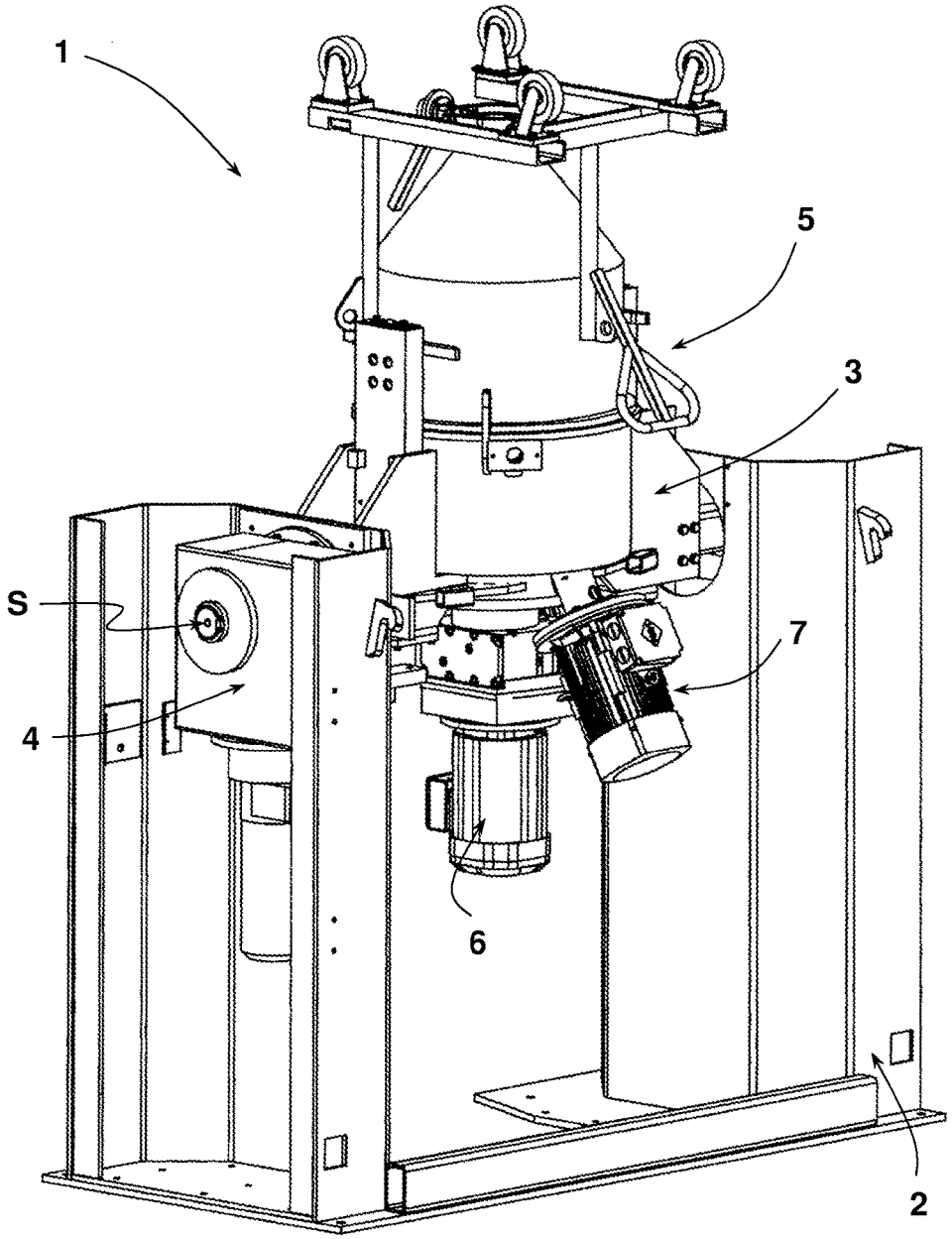
FIG. 1 is a schematic, perspective view of a mixing machine with a mixing container containing a material to be mixed on the mixing head of the mixing machine in the mixing position.

Before explaining the disclosed embodiment of the present invention in detail, it is to be understood that the invention is not limited in its application to the details of the particular arrangement shown, since the invention is capable of other embodiments. Exemplary embodiments are illustrated in referenced figures of the drawings. It is intended that the embodiments and figures disclosed herein are to be considered illustrative rather than limiting. Also, the terminology used herein is for the purpose of description and not of limitation.

DETAILED DESCRIPTION

A mixing machine 1 for industrial purposes comprises a machine frame 2 on which a mixing head 3 is pivotably supported. The pivot shaft of the mixing head 3 is made recognizable by the reference numeral S in FIG. 1. The mixing head 3 can be pivoted through at least 180° by a drive 4 about its pivot shaft S. In the exemplary embodiment shown, the pivotability of the mixing head 3 serves the purpose that in its position rotated through 180° in comparison to the view in FIG. 1 a mixing container 5 can be moved as a container containing mixing material to the mixing head 3 and can be connected to the latter in order to then be able to pivot the unit formed from mixing container 5 and mixing head 3—the actual mixing receptacle—into the position of the mixing head 3 shown in FIG. 1. In this position the mixing head 3 of the mixing machine 1 is at the bottom so that the material contained in the mixing container 5 falls onto the tools arranged in the mixing head 3. This position represents the mixing position of the mixing head 3 of the mixing machine 1.

The mixing head 3 of the exemplary embodiment shown comprises 2 tools that are driven in the exemplary embodiment shown by an electromotor 6, 7.

Figure 2:
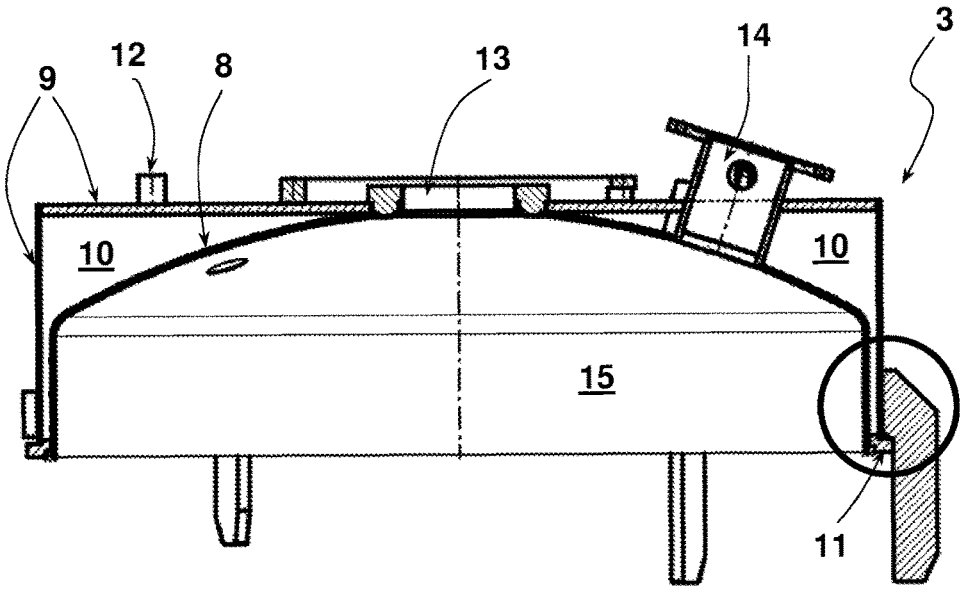
FIG. 2 is a schematic cross section through the mixing head of the mixing machine of FIG. 1 shown without mixing tools and with a liner set in it.
Figure 3:
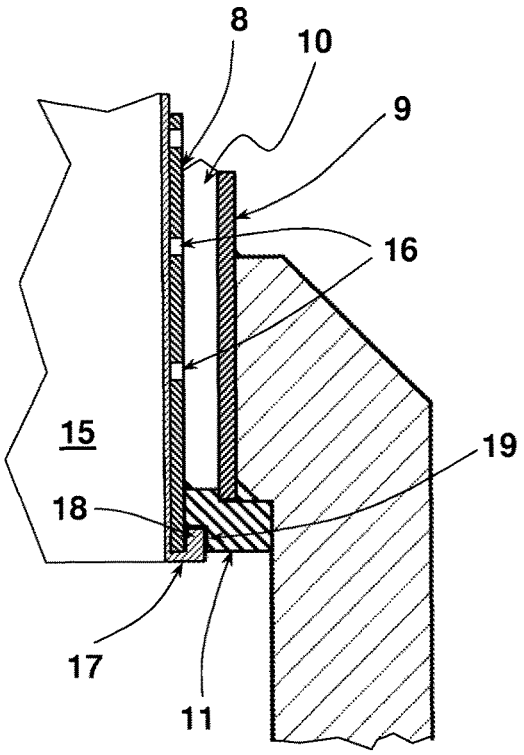
FIG. 3 is an enlarged detailed view of the section of the mixing head characterized in FIG. 2.

In the exemplary embodiment shown in the figures the mixing head 5 with its mixing tools is designed like the mixing head according to the exemplary embodiment of the FIGS. 1 to 3 in EP 2 460 581 A1. To this extent the descriptions of the mixing head that refer to EP 2 460 581 A1 are made subject matter of these comments and are used to describe the mixing head 3 of the exemplary embodiment shown by this explicit reference to the above-cited patent.

FIG. 2 shows the mixing head 3 of the mixing machine 1 by itself and without the mixing tools arranged in it and including the drive shafts driving the tools. The mixing head 3 is constructed as a double wall and comprises an inner wall 8 and an outer wall 9 enclosing the inner wall 8 with a space between them. In the exemplary embodiment shown the outer wall 9 surrounds the inner wall like a box. An intermediate wall chamber 10 is formed between the inner wall 8 and the outer wall 9. The intermediate wall chamber 10 is sealed against the outside environment. To this end an annular body 11 shown in FIG. 2 to connect the inner wall 8 to the lower closure of the outer wall 9. The annular body 11 also forms a connection flange as a support against which the connection flange of the mixing container 5 is pressed with its connection flange for forming a mixing receptacle. The intermediate wall chamber 10 serves in the mixing head 3 as a collector for a fluid, typically ambient air. The intermediate wall chamber 10 can be loaded with a vacuum or an excess pressure. To this end the intermediate wall chamber 10 is connected via a connection 12 and a connection line to a pressure adjustment device in a manner not shown in detail. The pressure prevailing in the intermediate wall chamber 10 can be adjusted with this device.

Openings 13, 14 sealed from the intermediate wall chamber 10 allow entrance of the drive shafts of the mixing tools not shown in the figure. In the mixing head 3 of the mixing machine 1, a rotationally driven, bottom-cleaning tool is arranged through the opening 13 while the opening14 serves for the drive shaft of a mixing tool that rotates more rapidly and is responsible for the actual mixing.

The chamber enclosed by the inner wall 10 forms, together with the hollow chamber of a mixing container connected to the mixing head 3, the hollow mixing chamber. The inside of the inner wall 8 is jacketed with a flexible liner 15. The arrangement of the liner 15 on the inner wall 8 can be recognized in the enlarged view of FIG. 3.

Figure 4:
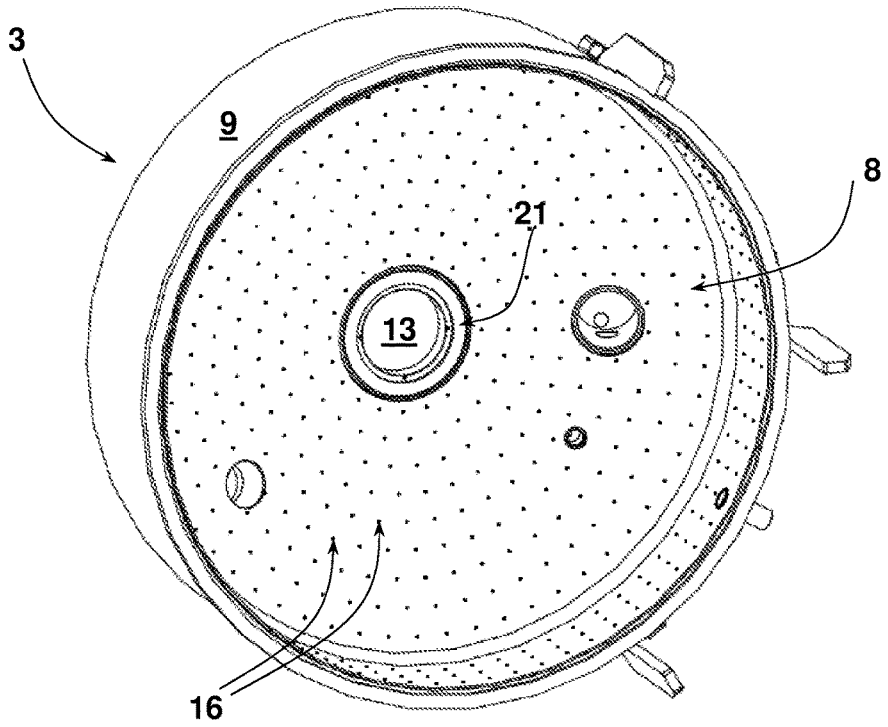
FIG. 4 is a perspective inside view of the mixing head without the inserted liner.

The inner wall 8 is perforated and carries in the manner of a grid perforation 16 distributed over its entire surface with which the intermediate wall chamber 10 is connected to the hollow chamber enclosed by the inner wall 8 (see also FIG. 4). The liner 15 of the exemplary embodiment shown is manufactured from a rubber material like a sheet and carries on its side facing the hollow chamber an adhesion-reducing coating which is constructed in the exemplary embodiment shown as a PTFE coating. The liner 15 typically comprises a Shore hardness A between 50 and 70 and therefore has a material elasticity corresponding approximately to those of a motor vehicle tire. This means that the liner 15 has a certain material elasticity. The liner 15 carries an outwardly projecting radial circumferential flange 17 on its end associated with the annular body 11. A connection continuation 18 in the manner of a lever edge is formed on the flange 17 and engages into a circumferential groove 19 of the annular body 11. In the exemplary embodiment shown the groove 19 is formed by an offset in the annular body 11 and the outside of the inner wall 8. The connection continuation 18 facing away from the contact side of the annular body 11 is frictionally held in the groove 19. This ensures that the liner 15 remains in the position shown in the FIGS. 2 and 3 even if no mixing container is connected to the mixing head 3. The liner 15 has a corresponding inherent stability so that it retains is shape shown in the FIGS. 2 and 3 even without additional measures and does not fall into the hollow chamber surrounded by the inner wall 8 even if no vacuum is present in the intermediate wall chamber 10.

In order to completely fix the liner 15 on the inner wall 8 the intermediate wall chamber 10 is loaded with a certain vacuum, for example 0.3-0.5 bar under ambient pressure. As a result of the sealing of the intermediate wall chamber 10 against the environment the liner 15 is attracted by suction onto the inside of the inner wall 8 by this measure. This ensures that the liner 15 remains in contact in its proper position with the inside of the inner wall 8 even in a mixing operation. The liner 15 and the side facing the hollow chamber are sufficiently wear-resistant for the material to be mixed with the mixing head 3.

Figure 5:
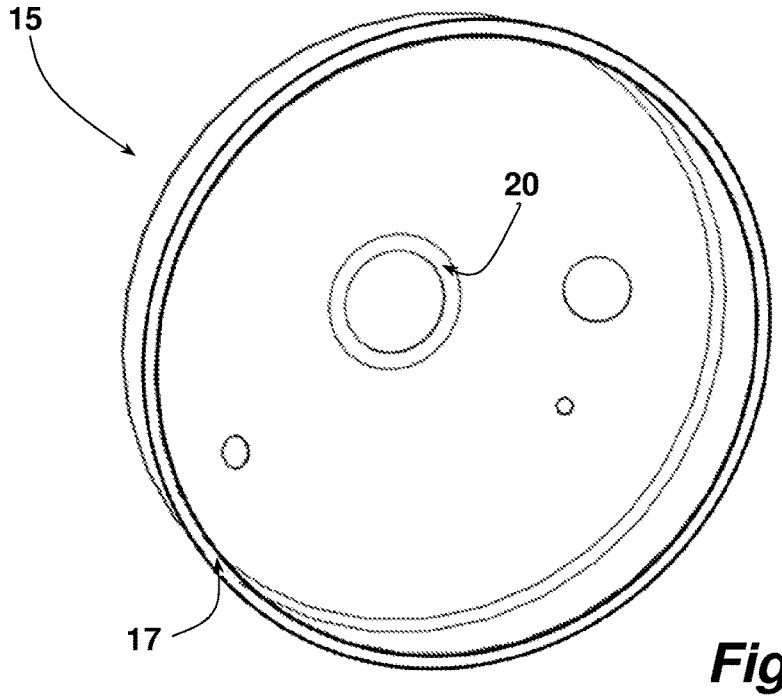
FIG. 5 is a perspective view of the liner set into the mixing head of the mixing machine of FIG. 1.

FIG. 5 shows the liner 15, whose geometry is adapted to the geometry of the inside of the inner wall 8. The liner 15 comprises corresponding perforations at those positions at which the drive shafts or other means, for example sensors, engage into the hollow chamber surrounded by the inner wall 8.

Figure 6:
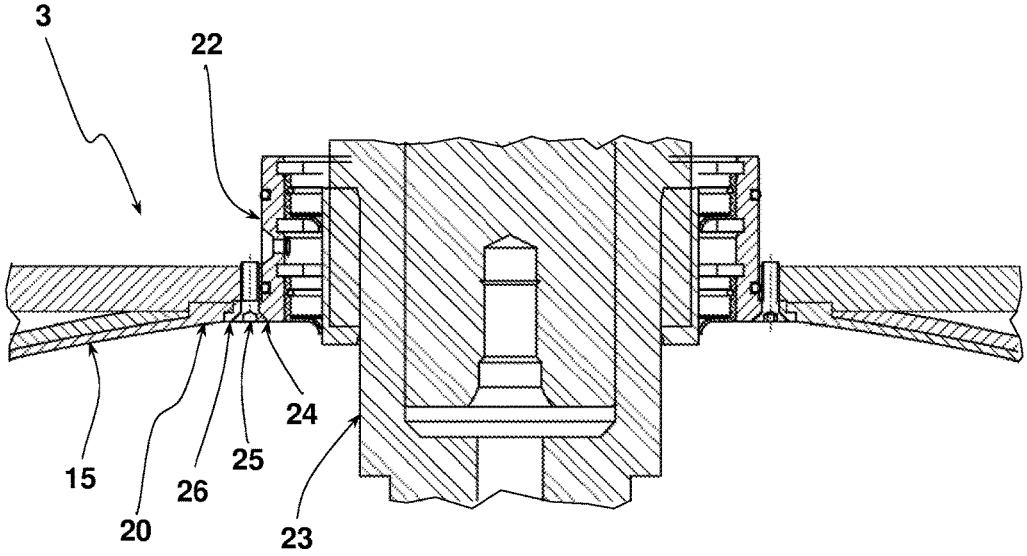
FIG. 6 is an enlarged and more detailed section from the bottom of the mixing head in the area of its perforation for running a drive shaft for a mixing tool through it.

FIG. 6 shows an enlarged sectional view of the area of the opening 13 for running the drive shaft for a mixing tool through the bottom of the mixing head 3 and through the liner 15 arranged in it. The related opening of the liner is surrounded by annular body 20 formed on the other components of the liner 15. The annular body 20 can comprise a steel inserter for reinforcement. The annular body 20 is constructed for engaging into a recess 21 of the bottom of the mixing head 3. A sealing sleeve 22 is inserted into the opening 13 of the mixing head 3. This sleeve seals the drive shaft 23 with fixing tool on the free end. Several shaft seals are held on the inside in the sealing sleeve 22. The sealing sleeve 22 itself comprises a radially outward projecting flange 24 which is fastened by several screws 25 on the bottom of the mixing head 3. The flange 24 is arranged on the side of the sealing sleeve 22 on the inside of the mixing head 3 and comprises an offset 26 on the outer surface. The offset overlaps a complementary offset of the annular body 20 of the liner 15. The annular body 20 is connected when the sealing sleeve is mounted to the bottom of the mixing head 3 by this overlapping of the flange 24 with its projection formed by the offset 26.

The drive shafts running through the openings 13, 14 are sealed against the openings 13, 14 by a slot seal so that they are washed with gas from the outside toward the inside. As a result, the internal pressure in the mixing receptacle is slowly raised during the mixing process so that the fixing of the liner on the inside of the inner wall 8 is additionally supported by this.

After a first mixing phase the mixing head 3 is pivoted back into its base position so that the mixing head 3 is again located at the top to remove not sufficiently mixed deposits of material in the area of the inside of the mixing head 3 at the end of the mixing process. To ensure any deposit of material that were not thoroughly mixed fall back into the mixed material the intermediate wall chamber 10 is loaded with a certain excess pressure in comparison to the pressure present in the mixing receptacle, for example 0.3-0.5 bar. This lifts the liner 15 off the inside of the inner wall 8, deforming it on account of its flexibility. As a result of this milling-like deformation, adhering deposits of material are loosened and fall back into the material contained in the mixing container. The mixing process is subsequently continued. Material that fell into the mixing material and was not yet sufficiently mixed is thoroughly mixed in the continuation of the mixing process. If deposits of material should be repeatedly observed they are then now thoroughly mixed mixing material.

In addition, it is advantageous when using a liner, as was presented in the previous exemplary embodiment, that this liner can be readily provided with adhesion-minimizing coatings, in any case in a much simpler manner than in the case of a steel surface.

The liner 15 can remain in the mixing head 3 during a cleaning of the mixing head 3. Generally, when cleaning of the mixing head 3 the mixing tools are removed from the mixing head 3. This allows for the possibility when cleaning the mixing head of replacing the liner 15. If it is to be expected that a batch of mixing material with the same material composition is to be mixed again, such a liner 15 removed from the mixing head 3 does not need to be cleaned. If a mixing batch is again mixed that corresponds to the one that was mixed with the liner 15, this liner can also be inserted uncleaned into the mixing head 3. This not only reduces the time necessary for a cleaning of the mixing head 3 but also reduces the associated costs and reduces the use of cleaning liquid and reduces the amount of cleaning liquid to be disposed.

Even if the liner 15 consists of a material which is resistant to wear regarding the mixing material to be mixed in the described exemplary embodiment, the claimed concept can also be used in order to introduce friction into the mixing material. The liner is then manufactured from such a material or has a coating consisting of such a material and facing into the hollow mixing chamber.

While a number of exemplary aspects and embodiments have been discussed above, those of skill in the art will recognize certain modifications, permutations, additions and sub-combinations therefore. It is therefore intended that the following appended claims hereinafter introduced are interpreted to include all such modifications, permutations, additions and sub-combinations are within their true spirit and scope. Each apparatus embodiment described herein has numerous equivalents.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims. In general the terms and phrases used herein have their art-recognized meaning, which can be found by reference to standard texts, journal references and contexts known to those skilled in the art. The above definitions are provided to clarify their specific use in the context of the invention.

LIST OF REFERENCE NUMERALS

1 Mixing machine
2 Machine frame
3 Mixing head
4 Pivoting drive
5 Mixing container
6 Electromotor
7 Electromotor
8 Inner wall
9 Outer wall
10 Intermediate wall chamber
11 Annular body
12 Connection
13 Perforation
14 Perforation
15 Liner
16 Perforation
17 Flange
18 Connection continuation
19 Groove
20 Annular body
21 Recess
22 Sealing sleeve
23 Drive shaft
24 Flange
25 Screw
26 Offset
S Pivot shaft

We claim:

1. A mixing machine comprising:

a mixing head having with one or more elements for connecting it to a receptacle forming a closed mixing container for containing a material to be mixed;

which mixing head is pivotably supported opposite a frame such that the mixing container can pivot for carrying out the mixing process;

the mixing head having at least one rotationally driven mixing tool with a drive shaft extending through the wall of the mixing head;

the mixing head having a double wall, wherein the inner wall of the double-wall construction is perforated to fluidly connect to an intermediate wall chamber between the inner wall and the outer wall;

the intermediate wall chamber is connected to a pressure adjustment device for adjusting the pressure in the intermediate wall chamber;

a flexible liner in the mixing head jacketing its inner surface made available by the inner wall; and which liner can be fixed to the inner wall of the mixing head by a vacuum applied in the intermediate wall chamber.

2. The mixing machine of claim 1, wherein the liner has a radially outward projecting circumferential flange on its end facing away from the bottom of the mixing head.

3. The mixing machine of claim 2, wherein a circumferential connection continuation is formed on the flange of the liner, the connection continuation engages in a circumferential groove of an annular body closing the intermediate wall chamber, wherein the flange of the liner simultaneously serves as a seal between the mixing head and a mixing receptacle connected thereto.

4. The mixing machine of claim 1, further comprising the liner having an opening surrounded by an annular body in an area of its bottom from admitting a sealing sleeve to admit a drive shaft having a mixing tool which is held by a clamping ring on the bottom of the mixing head.

5. The mixing machine of claim 4, wherein the clamping ring for holding the annular body of the liner is a radially outward projecting flange of the sealing sleeve extending through the bottom of the mixing head.

6. The mixing machine of claim 1, wherein the intermediate wall chamber can be loaded with excess pressure with the pressure adjustment device.

7. The mixing machine of claim 1, wherein the liner is manufactured from an elastic or rubbery elastic polymer.

8. The mixing machine of claim 7, wherein the inner wall of the liner is provided with an adhesion-minimizing coating and/or is provided with such a surface structuring.

* * * * *